US011051115B2

(12) United States Patent
Sheymov

(10) Patent No.: US 11,051,115 B2
(45) Date of Patent: Jun. 29, 2021

(54) CUSTOMIZABLE AUDIO SIGNAL SPECTRUM SHIFTING SYSTEM AND METHOD FOR TELEPHONES AND OTHER AUDIO-CAPABLE DEVICES

(71) Applicant: Olga Sheymov, Vienna, VA (US)

(72) Inventor: Victor Sheymov, Vienna, VA (US)

( * ) Notice: Subject to any disclaimer, the term of this patent is extended or adjusted under 35 U.S.C. 154(b) by 0 days.

(21) Appl. No.: 17/003,039

(22) Filed: Aug. 26, 2020

(65) Prior Publication Data

US 2020/0413205 A1 Dec. 31, 2020

Related U.S. Application Data

(60) Provisional application No. 62/921,601, filed on Jun. 27, 2019.

(51) Int. Cl.
*G10L 21/00* (2013.01)
*H04R 25/00* (2006.01)
*G10L 21/003* (2013.01)

(52) U.S. Cl.
CPC ..... *H04R 25/353* (2013.01); *G10L 21/003* (2013.01)

(58) Field of Classification Search
None
See application file for complete search history.

(56) References Cited

U.S. PATENT DOCUMENTS 5,771,299 A * 6/1998 Melanson ..... H04R 25/353 381/312
6,446,037 B1 * 9/2002 Fielder ..... G10L 19/0208 375/240
7,080,017 B2 * 7/2006 Fisher ..... G10L 19/02 704/205
7,702,115 B2 * 4/2010 Petuhov ..... H03G 9/005 381/61
7,801,559 B2 * 9/2010 Taylor ..... H04B 1/04 455/553.1
8,527,268 B2 * 9/2013 Quan ..... H04H 60/37 704/231
2001/0051870 A1 * 12/2001 Okazaki ..... G10L 21/003 704/207
2012/0004911 A1 * 1/2012 Quan ..... G10L 15/26 704/235

* cited by examiner

*Primary Examiner* — Satwant K Singh
(74) *Attorney, Agent, or Firm* — Dale J. Ream

(57) ABSTRACT

A method and system for improving the quality of audio communications as perceived by humans include audio signal spectrum frequency shift for enhancement of speech recognition by human customers, including mitigation of common age-related hearing loss on high audio frequencies.

11 Claims, 1 Drawing Sheet

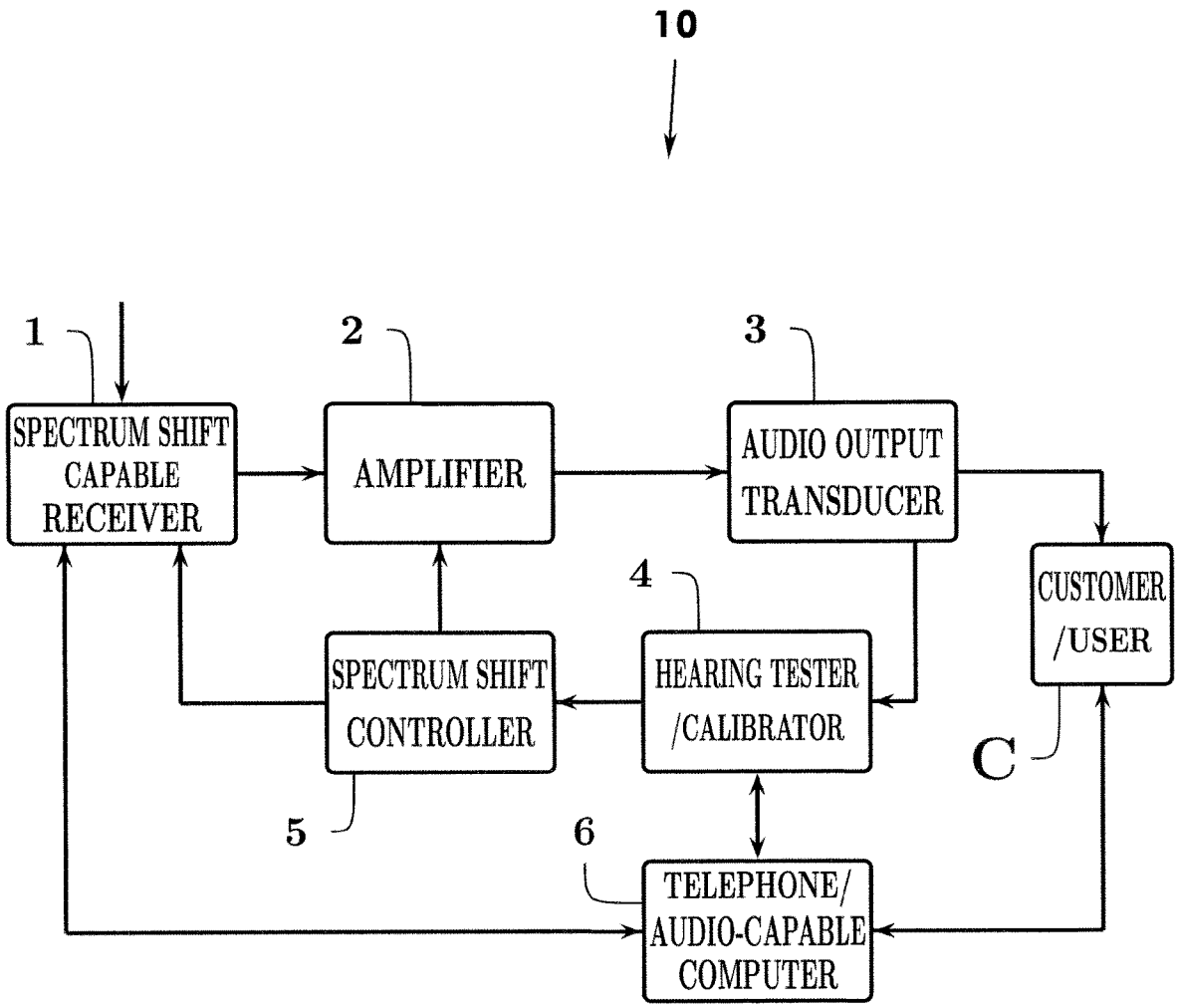
10
1
SPECTRUM SHIFT CAPABLE RECEIVER
2
AMPLIFIER
3
AUDIO OUTPUT TRANSDUCER
CUSTOMER /USER
C
4
HEARING TESTER /CALIBRATOR
SPECTRUM SHIFT CONTROLLER
5
6
TELEPHONE/ AUDIO-CAPABLE COMPUTER

CUSTOMIZABLE AUDIO SIGNAL SPECTRUM SHIFTING SYSTEM AND METHOD FOR TELEPHONES AND OTHER AUDIO-CAPABLE DEVICES

CROSS REFERENCES TO RELATED APPLICATIONS

This application claims the benefit of the U.S. provisional patent application 62/921,601 filed on 26 Aug. 2019 and titled Audio Signal Spectrum Shifting System and Method for Telephones and other Audio Capable Device This application is also related to the U.S. provisional patent application 62/921,601 filed 27 Jun. 2019 and titled Customizable Audio System and Method for Telephones and other Audio Capable Device.

COPYRIGHT NOTIFICATION

Portions of this patent application contain materials that are subject to copyright protection. The copyright owner has no objection to the facsimile reproduction by anyone of the patent document or the patent disclosure, as it appears in the Patent and Trademark Office patent file or records, but otherwise reserves all copyright rights whatsoever.

TECHNICAL FIELD

The present invention relates to methods and systems for improving quality of audio communications as audibly perceived by humans.

BACKGROUND

A significant percentage of the population is experiencing various hearing problems. While some of their needs are addressed by conventional hearing aids, the hearing aids are often insufficient or cumbersome, particularly when used during telephone conversation. Furthermore, people are not always wearing hearing aids and often have to take a phone call while not wearing a hearing aid. This creates a need for a telephone that would provide hearing assistance during a phone call independently of other means. Also, people without hearing problems have different acoustic preferences while listening to audio. This creates a need for a customizable audio system for use in telephones, audio-capable computers, and other computing and communication devices such as radio telephones and walkie-talkies, as well as aviation transceivers.

Conventional telephone audio systems usually address audio challenges through amplification.

Audio signal perception by a human user is a function of two components: human user's hearing and amplification by the device's audio system. However, human user's hearing loss in some part of the audio spectrum sometimes is so severe that available amplification cannot bring the signal volume to an acceptable level. This problem usually pertains to high end of the audio spectrum. Unfortunately, the high end of speech audio spectrum contains a lot of information that is essential for speech recognition. This is particularly evident when listening to a speaker with a high-pitched voice. In such cases, while the overall volume of the audio signal may be very high, the speech recognition may be severely damaged. In other words, amplification of low end of audio spectrum may be insufficient if the high end of the spectrum cannot be heard. This is particularly important for telephone speech communication, where the speech recognition may be an important part of the audio system's usefulness.

BRIEF DESCRIPTION OF FIGURES

FIG. 1 is a general functional diagram of the audio system according to a preferred embodiment of the present invention.

DETAILED DESCRIPTION OF THE PREFERRED EMBODIMENT

Detailed embodiments of the present invention are disclosed herein. However, it is to be understood that the disclosed embodiments are merely exemplary of the invention that may be embodied in various and alternative forms. Specific structural and functional details disclosed herein are not to be interpreted as limiting, but merely as a representative basis for the claims and/or as a representative basis for teaching one skilled in the art to variously employ the present invention.

Proposed System

The proposed system 10 is based on audio signal spectrum frequency shift. Hearing loss on some frequencies could be so significant that a combination of available amplification and output transducer parameters is still not sufficient to provide acceptable quality of audio signal for the customer. For example, this can happen with common age-related hearing loss on high audio frequencies. This effect can be particularly undesirable because often higher frequencies contain significant audio information important for speech recognition. In such a case, even with acceptable amplification in the lower part of the audio spectrum, speech recognition can be impaired. To address this challenge, the proposed system includes frequency spectral "shift," or frequency re-scaling. This shift can be performed by shifting the entire input audio signal to a different part of the audio spectrum [See sources 1-3, 5]. This can be done similarly to using a musical instrument and playing the same melody, for example, one octave lower. This shift can preserve much of the information in the input audio signal and thus present it in an audio spectrum that is better heard by a customer.

Also, this could make the "shifted" signal subject to easier amplification requirements, thus producing an audio signal for better speech recognition by customers with severe frequency loss in the high end of the audio spectrum. When customer's initial audiogram [4] shows severe high frequency loss that cannot be remedied by the combination of available amplification and output transducer parameters, the system executes the described frequency spectrum shift of the incoming signals that contain significant high frequency component.

In other words, it repeats volume of incoming signal's every detected audio frequency on a different corresponding lower frequency. The corresponding frequency is determined by a chosen coefficient, for example 1/2. This is done in a manner similar to a technique known in music industry as "pitch shift" [3]. The mentioned ratio 1/2 would become an equivalent of playing music melody one octave lower.

The proposed solution addressing the problem described above is represented by system 10 and method describe below. The system can be built in different implementations. It can be autonomous, i.e. built into a conventional telephone or other audio-5 capable communications devices. Alternatively, some of the system's functions can be implemented in a remote facility such as a carrier's or a provider's server or a phone manufacturer's service center which can be accessed remotely. Such implementation can provide some of the services described below in a remote mode.

The system's general functional diagram is depicted in Drawing FIG. 1.

Components of the System 10 (i.e. Explanation of the Reference Numerals of FIG. 1 and of the Method of Operation)

The system includes a Spectrum Shift capable Receiver 1 operable to receive an audio signal from communications line or other source through the telephone, computer, or other audio-capable device, including input transducer such as a microphone. Receiver 1 is capable of audio signal frequency spectral "shift," or spectral re-scaling, upon receiving a command from the Spectrum Shift Controller 5 or from manual command from a human user, as described below.

The system 10 includes an amplifier 2 electrically connected to the spectrum shift capable receiver 1, the amplifier 2 receiving an electronic form of audio signals from receiver 1. The amplifier 2 performs signal amplification in accordance with pre-programmed instructions and provides it to the Audio Output Transducer 3 such as a telephone speaker or headphones.

The system 10 includes an audio output transducer 3 (such as a speaker, headphones, or a similar device), usually a part of a telephone or other audio-capable device), the audio output transducer 3 operable to receive electronic signals from Amplifier 2 directly, or through wired or wireless connection such as Bluetooth. The audio output transducer 3 is operable to convert received electromagnetic signals into audio signals to be heard by a human Customer C.

The system 10 includes a hearing tester/calibrator 4 in electrical communication with the amplifier 2 and operative to administer automated speech recognition tests through audio output transducer 3 and, ultimately, to the customer (user) C. Based on the tests results, it determines frequency threshold for acceptable speech recognition for user C through Transducer 3. The goal of the test is to determine a volume level for the highest frequency needed for acceptable speech recognition. The hearing tester/calibrator 4 provides the determined value of the threshold to a spectrum shift controller 5 for decision and implementation of the audio signal spectrum shift. This type of test has two advantages over a conventional audio test: it is automated (i.e. does not require a visit to a specialist), and it also includes a specific output transducer, thus addressing variations in the transducers' parameters. The later may improve accuracy since it tests human hearing with a specific transducer to be used in the device, vs. a generic transducer used in a conventional audio test. Functions of the hearing tester/calibrator 4 can be implemented in the telephone autonomously, or remotely from a centralized location such as manufacturer's or service provider's server, or it can be partially implemented 5 at both locations.

The spectrum shift controller 5 determines if an amplified audio signal from amplifier 2 is sufficient for speech recognition in of the audio spectrum, particularly in the high-frequency end of the spectrum. If the signal is not sufficient, it gives a command to receiver 1 to "shift" the entire incoming signal spectrum toward a lower frequency.

A telephone/audio-capable computer 6 is a host device for the system 10, such as a telephone, an audio-capable computer, or other computing and communications device such as a radio telephone, a walkie-talkie as well as an aviation transceiver. It interacts with the proposed system 10 by forwarding the incoming signal, and also providing means of control such as a dedicated button, or use of existing buttons for turning spectrum shift on.

A human user/customer is referred to with reference character "C" and is expected to turn the parameter of the spectrum shift on and off by use of a dedicated or existing button of the telephone or other audio-capable device. It is capable of overriding a spectrum shift command from the spectrum shift controller 4. It is understood that a human person is not actually a component of the invention but intended to participate in the method of using the system 10.

Modes of Operation

The system functions in two modes:

1. Initial Calibration/Subsequent Adjustment
2. Normal Operation, i.e. providing customized fine-tuned optimized audio signal to customer 1. Initial Calibration/Subsequent Adjustment mode—the hearing tester/calibrator 4 administers automated speech recognition in initial configuration of the telephone or other audio-capable device. The initial test is similar to a common speech recognition test provided by audiologists. The test determines the minimal required signal volume at the highest frequency necessary for the incoming audio signal that is necessary for acceptable speech recognition by Customer C receiving the signal through transducer 3. This test is performed at the initial calibration and can also be used later for fine-tuning, allowing for flexibility of addressing possible hearing changes of a customer in time. Also, this telephone/audio-capable computer 6 can allow adjustment and programming of the amplifier 2 parameters in a case of changing the transducer 3. It should be noted that, for convenience purposes, a customer may want to calibrate the system to more than one transducer. This would require having more than one amplification schedule in amplifier 2. The system 10 can be programmed to choose a particular amplification schedule automatically in accordance with a particular transducer used at the time. Also, this system 10 allows the phone to be customized for subsequent users. Further yet, this system 10 can be expanded to include customization for several customers (such as in a family use) with every customer turning on a specific customization upon taking up the phone.

2. Normal Operation—The hearing tester/calibrator 4 is turned off and the system 10 automatically fine-tunes received audio signals in accordance with a customer's specific individual needs, with a frequency spectrum "shift," when it is determined necessary for acceptable speech recognition. The system 10 can have a manual override. For example, if the system 10 does not perform spectrum "shift" automatically, the shift can be ordered manually by customer's command, for example by pushing a dedicated or programmed standard button of the phone. Also, an automatic shift can be cancelled manually if the customer does not recognize its usefulness.

It should be noted that the system 10 can be used without a communications line. In this case it can act as a hearing aid, receiving and amplifying audio signals through its input 20 transducers such as microphones (not shown in FIG. 1).

The proposed system 10 can be built in an autonomous implementation, when it is fully contained in a telephone or another audio-capable device. It can also be built in a centralized implementation, when some or all functions of the system are placed in a remote location such as a communications carrier's or a phone manufacturer's service center.

Regarding the invention being thus described, it will be obvious that the same may be varied in many ways. Such variations are not to be regarded as a departure from the spirit and scope of the invention, and all such modifications as would be obvious to one skilled in the art are intended to be included within the scope of the claims. It is to be understood that while certain now preferred forms of this invention have been illustrated and described, it is not limited thereto except insofar as such limitations are included in the following claims.

REFERENCES

[1] Mark Dolson. The phase vocoder: A tutorial. Computer Music Journal, 10(4):14-27, 1986.

[2] J. L. Flanagan and R. M. Golden. Phase vocoder. 5 Bell System Technical Journal, pages 1493-1509, November 1966.

[3] Jean Laroche and Mark Dolson. New phase vocoder technique for pitch-shifting, harmonizing and other exotic e↵ects. In IEEE Workshop on Applications of Signal Processing to Audio and Acoustics, New Paltz, N.Y., 17-20 Oct. 1999.

[4] Frederick N. Martin and John Greer Clark. Introduction to Audiology. Pearson, 12th edition, 2014.

[5] M. R. Portno↵. Implementation of the digital phase vocoder using the fast Fourier transform. IEEE Trans. Acous., Speech, Sig. Proc., 24(3):243-248, June 1976.

What is claimed is:

1. A system for enhancing an audio communications signal as perceived by a human user, the system comprising:

a spectrum shift capable receiver operable to produce an electronic form of the audio communications signal;

an amplifier operable to receive said electronic form of said audio communications signal, perform signal amplification, and generate an electronic input;

an audio output transducer operable to receive said electronic input from said amplifier and to convert said electronic input into an output audio signal that is audible to the human user;

a hearing tester operable to administer an automated speech recognition test through said audio output transducer to the human user, to determine a frequency threshold for acceptable speech recognition associated with the human user, and to transmit a value of said frequency threshold to said spectrum shift controller for decision and implementation of said audio signal spectral shift; and a spectrum shift controller operable to receive audio signals from a source and capable of audio signal spectral shift upon receiving an associated controller command;

wherein said spectrum shift controller is operable to determine if said audio signal spectral shift improves speech recognition by the human user and wherein said spectrum shift controller is operable to generate a spectrum shift command, wherein said spectrum shift command is said controller command to said spectrum shift capable receiver to implement said audio signal spectral shift.

2. The system of claim 1 wherein said audio signal spectral shift is characterized by a spectral shift amount and wherein said value of said frequency threshold is indicative of said spectral shift amount.

3. The system of claim 1 wherein said amplifier performs said signal amplification in accordance with an amplification schedule comprising pre-programmed instructions, and wherein said automated speech recognition test determines said pre-programmed instructions by measuring the minimal required signal volume at the highest frequency that is necessary for acceptable speech recognition of said output audio signal by said human user.

4. The system of claim 1 wherein the functions of said hearing tester are implemented remotely from a centralized location.

5. The system of claim 1 wherein said controller command to said spectrum shift capable receiver is a manual command capable of overriding said spectrum shift command.

6. The system of claim 1 wherein said host device is implemented in a remote location.

7. The system of claim 1 wherein said source audio signal is selected from the group consisting of a signal from an input transducer, a wireless communication signal, a wireline communication signal, and combinations thereof.

8. The system of claim 1, wherein said host device is an autonomous audio-capable device selected from the group consisting of a telephone, a radio telephone, a walkie-talkie, an aviation transceiver, an audio-capable computer, and combinations thereof.

9. The system of claim 8 wherein the functions of said hearing tester are implemented autonomously in said autonomous audio-capable device.

10. The system of claim 9 wherein said amplifier is operable to execute said signal amplification according to an additional amplification schedule comprising pre-programmed instructions, and wherein said automated speech recognition test determines said pre-programmed instructions by measuring a minimal required signal volume at a high frequency that is necessary for acceptable speech recognition of said output audio signal.

11. A method for improving quality of an audio communications signal as perceived by humans, the method comprising:

receiving an audio signal;

converting said audio signal into an electronic form of said audio signal;

wherein said conversion of said audio signal comprises spectral shift of said audio signal and wherein said spectral shift is characterized by a predetermined spectral shift amount;

converting said electronic form of said audio signal into an output audio signal that is audible to a human user;

administering an automated speech recognition test to determine a frequency threshold for acceptable speech recognition by said human user, and utilizing said frequency threshold to determine said spectral shift amount;

amplifying of said electronic form of said audio signal according to an amplification schedule that includes a plurality of pre-programmed instructions; and wherein said automated speech recognition test determines said pre-programmed instructions by measuring the minimal required signal volume at a frequency for acceptable speech recognition of said output audio signal by said human user.

* * * * *